US005611496A

United States Patent [19]

Fleenor

[11] Patent Number: 5,611,496

[45] Date of Patent: Mar. 18, 1997

[54] HAMMERMILL HAVING SEALED HAMMERS

[75] Inventor: Jeff A. Fleenor, Pella, Iowa

[73] Assignee: Vermeer Manufacturing Corporation, Pella, Iowa

[21] Appl. No.: 428,528

[22] Filed: Apr. 25, 1995

[51] Int. Cl.[6] ..... B02C 13/04

[52] U.S. Cl. ..... 241/166; 241/194; 241/197

[58] Field of Search ..... 241/194, 195, 241/197, 166

[56] References Cited

U.S. PATENT DOCUMENTS

| | | | |
|---|---|---|---|
| 3,917,179 | 11/1975 | Graf | 241/194 |
| 4,311,284 | 1/1982 | Ratcliff, Jr. | 241/191 |
| 4,313,575 | 2/1982 | Stepanek | 241/194 |
| 4,344,581 | 8/1982 | Redemann | 241/88.4 |
| 4,585,180 | 4/1986 | Potts . | |
| 4,915,310 | 4/1990 | Stelk | 241/197 |
| 5,114,085 | 5/1992 | Inui | 241/195 |
| 5,188,303 | 2/1993 | Hoof | 241/194 |
| 5,272,861 | 12/1993 | Roynberg | 241/194 X |
| 5,332,164 | 7/1994 | Page | 241/239 |
| 5,377,919 | 1/1995 | Rogers et al. | 241/189.2 |
| 5,419,502 | 5/1995 | Morey | 241/197 X |
| 5,507,441 | 4/1996 | De Boef et al. | 241/73 |

OTHER PUBLICATIONS

Apr. 1986 Caterpillar Track Systems Brochure.

1983 Belleville Springs for bolted applications Brochure by Rolex Company.

*Primary Examiner*—John M. Husar

*Attorney, Agent, or Firm*—Merchant & Gould

[57] ABSTRACT

A hammermill including a main shaft rotatable about a main axis passing longitudinally through the main shaft. Connected to the main shaft and spaced longitudinally along the main axis are a plurality of substantially parallel plates. Pivotally mounted between the plates along pivot axes parallel to and spaced from the main axis are a plurality of free swinging hammers for crushing material. A plurality of sealing members are positioned along the pivot axes and compressed between the hammers and the plates.

9 Claims, 4 Drawing Sheets

HAMMERMILL HAVING SEALED HAMMERS

FIELD OF THE INVENTION

The present invention relates generally to hammermills for crushing and grinding material. Specifically, the present invention relates to hammermills including sealed pivoted hammers.

BACKGROUND OF THE INVENTION

The increased costs of disposing material in landfills has intensified the need for developing cost effective machines for reducing the volume of waste material.

Hammermills have conventionally been employed to reduce the volume of waste material. Conventional hammermills have a shaft which is rotatably driven about a longitudinal axis. A plurality plates are mounted in longitudinally spaced relation along the length of the shaft. A plurality of swinging hammers are pivotally mounted between the plates on pivot shafts.

Upon rotation of the shaft, the hammers are swung radially outward from the shaft such that an impact zone is formed about the shaft. The material to be reduced is introduced into the impact zone and impacted by the swinging hammers. The swinging hammers repeatedly impact the material within the impact zone thereby crushing and grinding the material such that the material volume is reduced.

Due to a variety of factors, conventional hammermills employing pivotally mounted hammers have relatively short useful lives. For example, one factor which negatively affects hammermills is the accumulation of dirt and debris between the hammers and the plates and along the pivot shafts of the hammers. The accumulation of dirt and debris causes excessive wear of the hammers, plates and pivot shafts. Additionally, the material build-up frequently interferes with the proper pivotal motion of the hammers.

Another factor which shortens the life of conventional hammermills relates to the fact that the hammers are not always centered between the plates. The improper centering of the hammers allows contact between the hammers and the plates as the hammers are pivoted which causes premature wearing of the plates and hammers. Additionally, if the centering problem is severe, the hammers may become jammed between the plates such that the hammers are no longer free to pivot.

An additional factor causing premature wear in conventional hammermills having pivoting hammers relates to recoil impacts between the hammers and the main shaft. When conventional hammermill hammers are used to crush hard material such as stone, the intense reactionary forces caused by impact with the hard material causes the hammers to recoil and sharply impact the main shaft. This dual impact of the hammers significantly shortens the life of the hammers.

A further cause of wear in conventional hammermills is the presence of long and thin material such as string, magnetic tape and wire in the material to be reduced. The long and thin material has a tendency to wrap between the hammers and the plates thereby interfering with the pivotal motion of the hammers and shortening the useful life of conventional hammermills.

What is needed is an improved hammermill having a longer useful life and requiring reduced maintenance. What is also needed is a hammermill which prevents debris from accumulating between the hammers and the plates. What is additionally needed is a hammermill having centered hammers. What is further needed is a hammermill which brakes the recoil of the hammers. Moreover, what is needed is a hammermill which cuts material that becomes wrapped between the hammers and the plates.

SUMMARY OF THE INVENTION

The present invention relates to a hammermill including a main shaft rotatable about a main axis passing longitudinally through the main shaft. A plurality of substantially parallel plates are connected to the main shaft and spaced longitudinally along the main axis. Pivotally mounted between the plates along pivot axes parallel to and spaced from the main axis are a plurality of free swinging hammers. A plurality of sealing members are positioned along the pivot axes and compressed between the hammers and the plates. The sealing members prevent debris from accumulating between the hammers and the plates and effectively center the hammers between the plates. The sealing members also act as friction brakes for slowing the recoils of the hammers.

Another aspect of the present invention relates to a cutting structure for cutting material which becomes wrapped between the hammers and the plates.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
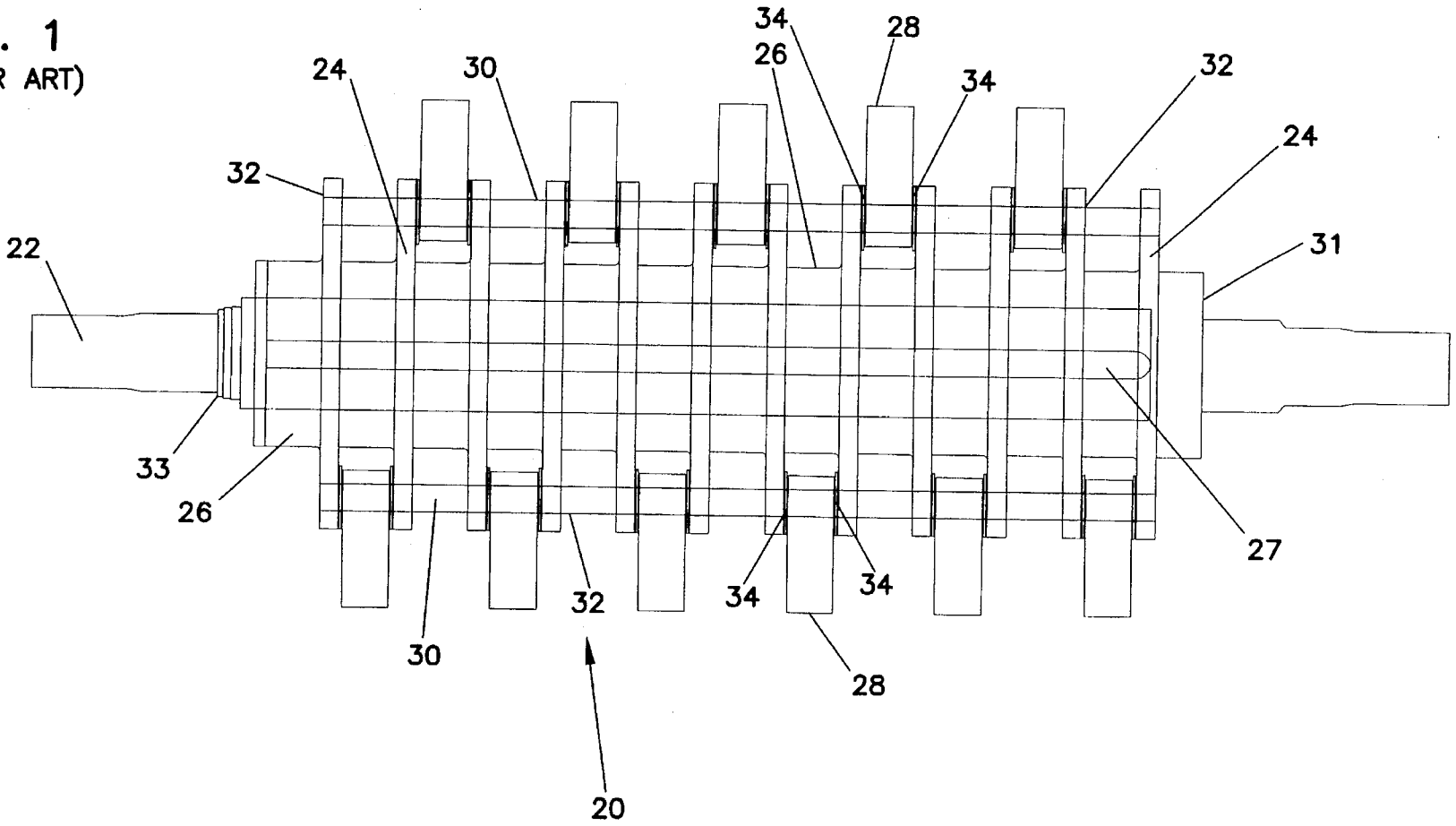
FIG. 1 (PRIOR ART)
FIG. 1 is a front view of a known hammermill.

Referring to FIG. 1, there is illustrated a hammermill 20 previously described in greater detail in U.S. patent application Ser. No. 08/177,212 now U.S. Pat. No. 5,507,441 which is hereby incorporated by reference. The hammermill 20 includes a main shaft 22 which is rotated about a longitudinal axis by conventional driving mechanisms such as gas or electric powered motors. Mounted in longitudinally spaced relation along the shaft 22 are a plurality of plates 24. Associated with the plates 24 are a plurality of hubs 26 for maintaining spacing of the plates 24 along the shaft 22. The plates 24 each have keyways which mate with a longitudinally extended key 27 formed by the main shaft 22 for preventing relative rotation between the shaft 22 and the plates 24. The plates 24 and hubs 26 are prevented from moving longitudinally along the main shaft 22 by an end plate 31 rigidly connected to one end of the main shaft 22 and a nut 33 threaded onto the other end of the main shaft 22 such that the plates 24 and associated hubs 26 are compressed between the end plate 31 and the nut 33.

A plurality of free swinging hammers 28 are pivotally mounted between the plates 24 along pivot axes parallel to and spaced from the main axis. The free swinging hammers 28 are pivotally mounted on pivot pins 30 which are aligned along the pivot axes. The pivot pins 30 extend through linearly aligned holes 32 defined by the plates 24 at locations proximate the outer circumference of the plates 24. The hammers 28 are free to pivot about their corresponding pivot pins 30 within the area of motion defined by contact of the hammers 28 with the main shaft 22.

Flat washers 34 are loosely fit between the hammers 28 and the plates 24 such that gaps exist between the hammers 28 and the plates 24. The gaps allow dirt and debris to enter into the pivot pin 30 and hub 26 area. Additionally, the gaps 34 allow the hammers 28 to become misaligned between the plates 24 thereby potentially causing damage to the hammers 28 through contact with the plates 24 and also allowing the hammers 28 to potentially become jammed between the plates 24 thereby interfering with the pivotal motion of the hammers 28.

Figure 2:
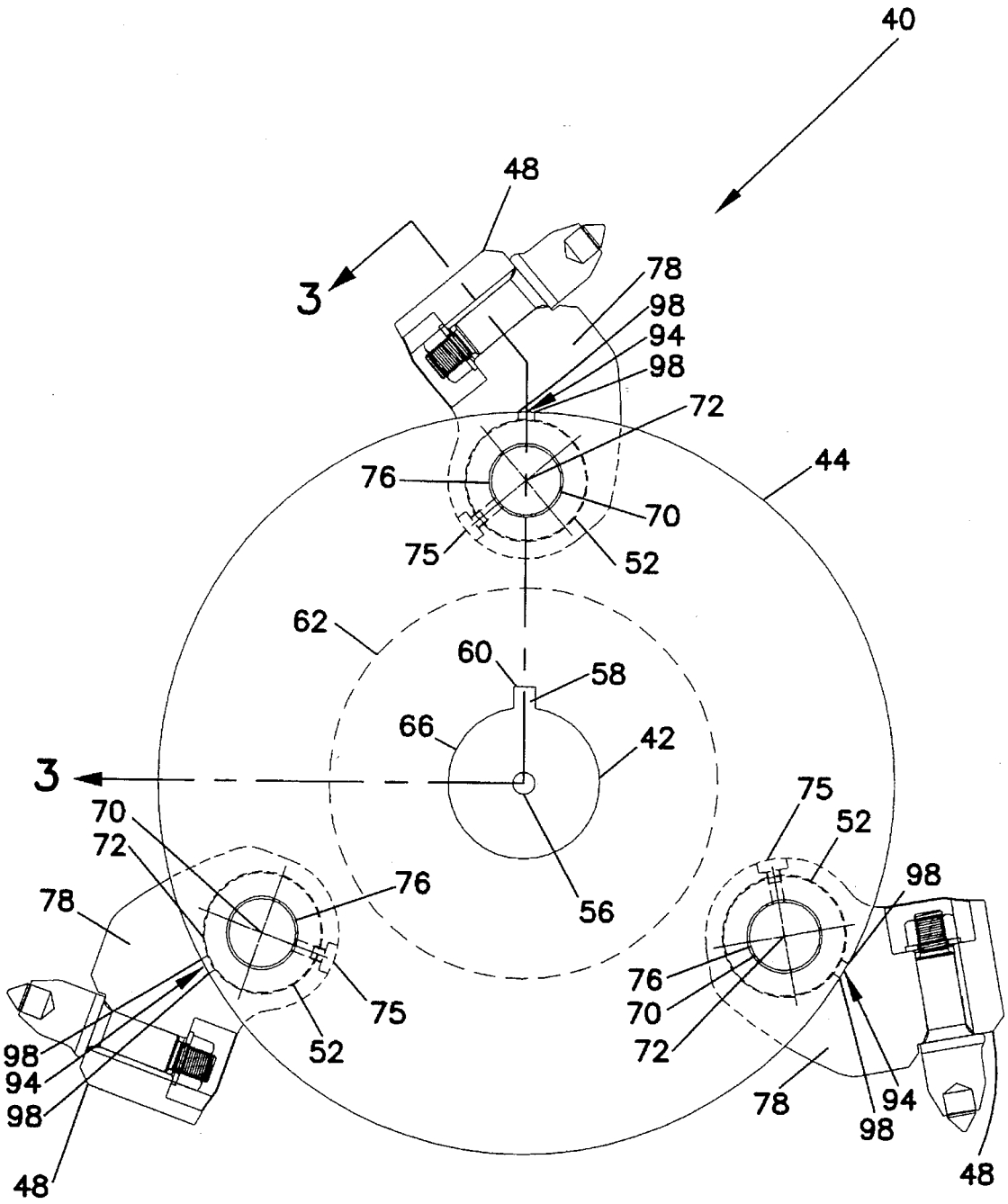
FIG. 2 is a side view of an embodiment of a hammermill which is illustrative of the present invention.
Figure 3:
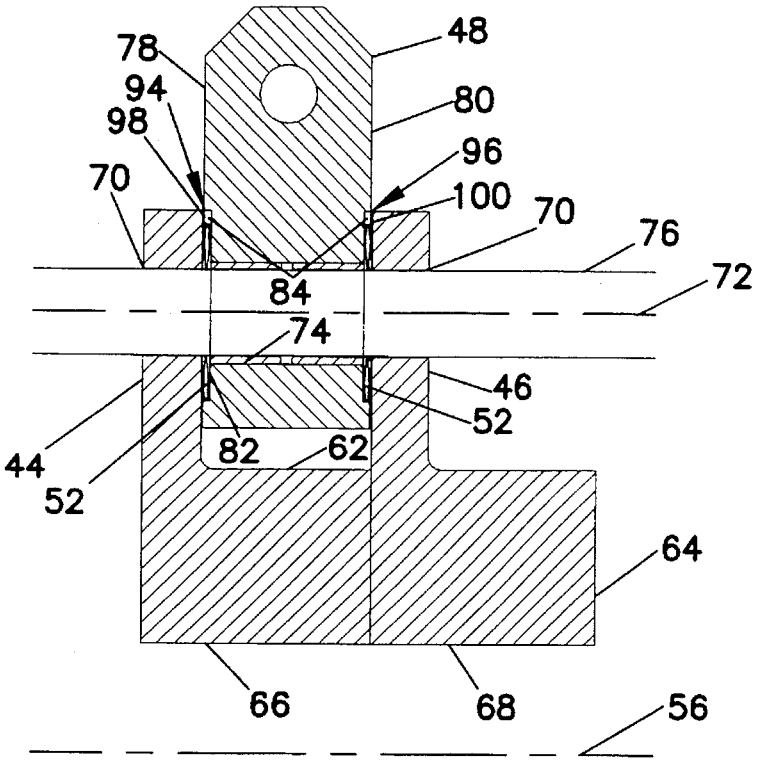
FIG. 3 is a cross-sectional view of the hammermill of FIG. 2 taken along section line 3—3.
Figure 4:
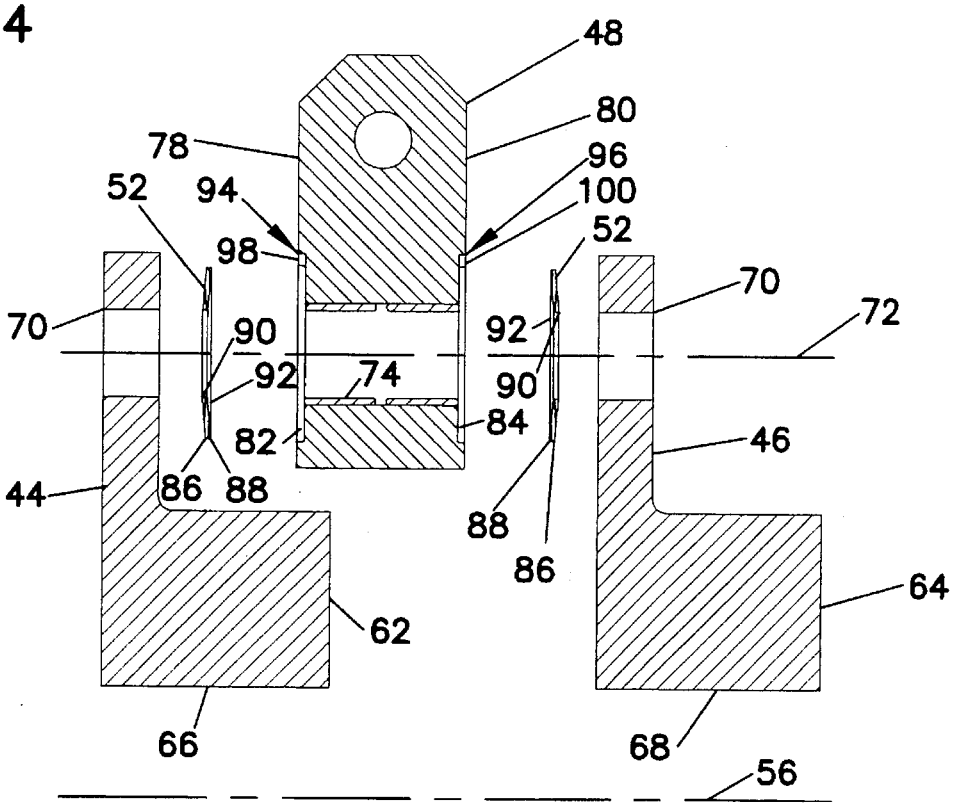
FIG. 4 is an exploded view of the cross-sectional view of FIG. 3.

Referring to FIGS. 2–4, there is shown a hammermill 40 constructed in accordance with the principles of the present invention. The hammermill 40 preferably includes a plurality of plates mounted along a main shaft in a manner similar to the hammermill 20 of FIG. 1. However, for the purposes of illustration, the hammermill 40 illustrated in FIGS. 2–4 is shown including a main shaft 42 having a first plate 44 and a second plate 46 non-rotatedly mounted thereon. It will be appreciated that additional sets of plates having the same structure as the plates 44 and 46 may be mounted longitudinally along the main shaft 42.

A plurality of hammers 48 are pivotally mounted between the first and second plates 44 and 46 such that when the shaft 42 is rotated, the hammers 48 swing freely to crush material that is located within the swinging path of the hammers 48. A plurality of sealing members 52 are positioned between the hammers 48 and the first and second plates 44 and 46 to prevent debris from interfering with the pivotal motion of the hammers 48. The specific features of each of the hammermill 40 components described above are as follows.

The main shaft 42 of the hammermill 40 is generally cylindrical and is rotatable about a main axis 56 passing longitudinally through the main shaft 42. The main shaft 42 is preferably rotated about the main axis 56 by a conventional drive mechanism (not shown) such as an electric or gas powered motor. The main shaft 42 preferably includes a longitudinal key 58, similar to the key 27 of the hammermill 20 of FIG. 1, which mates with keyways 60 associated with the plates 44 and 46 to prevent relative rotation between the shaft 42 and the plates 44 and 46. Furthermore, also similar to the hammermill 20 of FIG. 1, the hammermill 40 preferably includes an end plate (not shown) and a nut (not shown) for preventing the plates 44 and 46 from moving longitudinally along the shaft 42.

The first and second plates 44 and 46 are preferably integrally formed with and extend radially outward from corresponding first and second hubs 62 and 64. The first and second hubs 62 and 64 define first and second central bores 66 and 68 which receive the main shaft 42 for mounting the hubs 62 and 64 and associated plates 44 and 46 on the main shaft 42. Within the central bores 66 and 68, the hubs 62 and 64 preferably define the keyways 60 which mate with the longitudinal key 58 defined by the main shaft 42 for preventing relative rotation between the shaft 42 and the hubs 62 and 64.

As mounted on the main shaft 42, the first and second plates 46 and 48 oppose and are generally parallel to each other with spacing between the plates 46 and 48 maintained by the first hub 62. The first and second plates 44 and 46 define sets of pivot holes 70 which are linearly aligned along pivot axes 72 oriented parallel to and spaced from the main axis 42.

The hammers 48 of the hammermill 40 are pivotally mounted between the first and second plates 44 and 46. As mounted between the plates 44 and 46, the hammers 48 define hammer bores 74 which are longitudinally aligned along the pivot axes 72 between the sets of pivot holes 70 defined by the first and second plates 44 and 46. The hammers 48 are pivotally mounted between the first and second plates 44 and 46 on pivot shafts 76 aligned along the pivot axis 72 and extending through the hammer bores 74 and pivot holes 70 of the first and second plates 44 and 46.

Each hammer 48 includes a first surface 78 facing the first plate 44 and a second surface 80 facing the second plate 46. Counterbored about the hammer bores 74 within the first surfaces 78 are circular first recesses 82. Similarly, counterbored within the second surfaces 80 about the hammer bores 74 are circular second recesses 84.

It will be appreciated that the hammers 48 may be constructed in a variety of conventionally employed shapes and sizes. Additionally, it will also be appreciated that the hammers 48 include lubrication holes 75 tapped through the hammers 48 and in fluid communication with the hammer bores 74. The lubrication holes 75 are sealable by a tap screw and allow the pivot shafts 76 and hammer bores 74 to be lubricated.

The sealing members 52 of the hammermill 40 preferably have a resilient/elastic structure which allows the sealing members 52 to be compressed between the hammers 48 and the first and second plates 44 and 46. A preferred sealing member 52 is a spring washer/disc spring 86 constructed of a material such as hardened steel. Suitable spring washers 86 are manufactured by Rolex Company under the tradename Belleville Springs. Although spring washers 86 are the preferred sealing members 52, it will be appreciated that alternate resilient members may also be employed without departing from the scope of the present invention.

Figure 5:
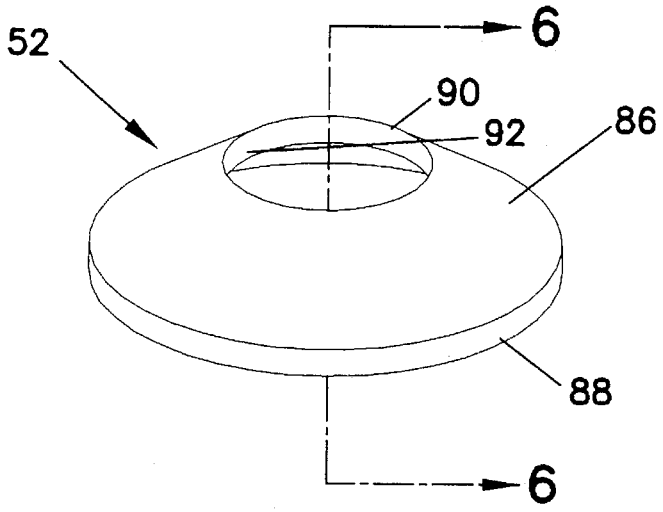
FIG. 5 is a perspective view of an embodiment of a sealing member which is employed by the present invention.
Figure 6:
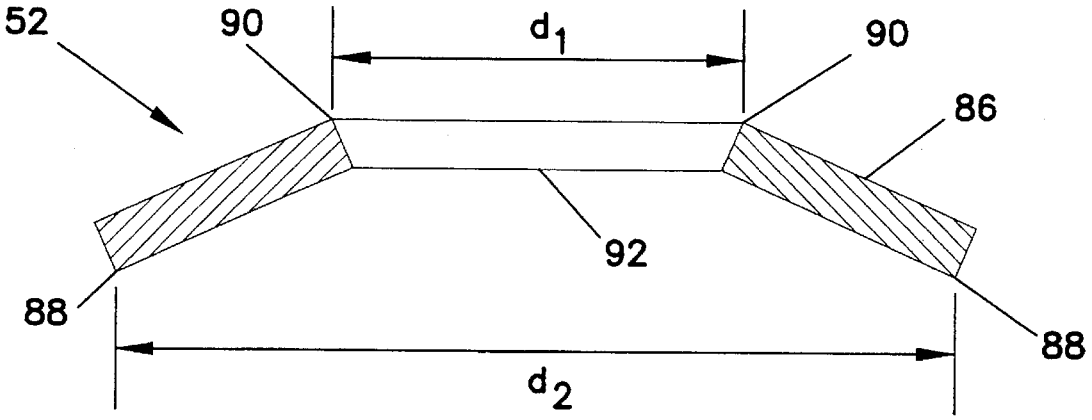
FIG. 6 is a cross-sectional view of the sealing member of FIG. 5 taken along section line 6—6.

Referring to FIGS. 5 and 6, there is illustrated an embodiment of the type of spring washers 86 which are preferably employed as sealing members 52 in the hammermill 40. The spring washer 86 includes a circular base edge 88 and an circular apex edge 90. The spring washer 86 defines a central aperture 92 which extends from the base edge 88 to the apex edge 90 of the spring washer 86. The diameter $d_1$ of the central aperture 92 adjacent to the apex edge 90 is generally sized slightly larger than the diameters of the pivot shafts 76. The diameter $d_2$ of the central aperture 92 adjacent to the base edge 88 of the spring washer 86 is larger than the diameter $d_1$ adjacent to the apex edge 90.

As best shown in FIG. 4, during assembly of the hammermill 40, the base edges 88 of the spring washers 86 are inserted within the first and second recesses 82 and 84 of the hammers 48. As inserted, the central apertures 92 of the spring washers 86 are aligned with the hammer bores 74 and the spring washers 86 extend outward from the recesses 82 and 84 such that the apex edges 90 are positioned past the first and second surfaces 78 and 80 of the hammers 48. The hammers 48 holding the spring washers 86 are forcibly inserted between the first and second plates 44 and 46 thereby compressing the spring washers 86 within the recesses 82 and 84 between the hammer surfaces 78 and 80 and the first and second plates 44 and 46.

The first and second recesses 82 and 84 serve the purpose of maintaining alignment of the central apertures 92 of the spring washers 86 with the hammer bores 74 during assembly of the hammermill 40. Once the hammers 48 are arranged such that the hammer bores 74 are generally aligned with the pivot axes 72, tapered drift pins (not shown) are driven by the pivot shafts 76 along the pivot axes 72 through the sets of pivot holes 70 defined by the plates 44 and 46, the central apertures 92 defined by the spring washers 86 and the hammer bores 74. As assembled, the pivot shafts 76 are aligned along the pivot axes 72 and extend through the sets of pivot holes 70 defined by the plates 44 and 46, the central apertures 92 defined by the spring washers 86 and the hammer bores 74.

When the spring washers 86 are compressed within the recesses 82 and 84 between the first and second surfaces 78 and 80 of the hammers 48 and the first and second plates 44 and 46, the spring washers 86 are caused to flatten. The flattened spring washers 86 exert uniform pressure on the first and second surfaces 78 and 80 of the hammers 48 and on the first and second plates 44 and 46. The pressurized contact of the apex edges 90 of the spring washers 86 with the first and second plates 44 and 46 essentially forms hermetic seals between the apex edges 90 and the first and second plates 44 and 46. Similarly, the pressurized contact of the base edges 88 with the first and second surfaces 78 and 80 essentially forms hermetic seals between the base edges 88 and the first and second surfaces 78 and 80.

The sealing effect of the spring washers 86 seals lubricants within the hammer bores 74 and also keeps dirt and debris out of the pivot shaft 76 and hub 62 and 64 area. Additionally, the spring washers 86 center the hammers 48 between the first and second plates 44 and 46 to prevent contact between the hammers 48 and the first and second plates 44 and 46. Furthermore, the spring washers 86 act as friction brakes to dampen the shock load when the hammers 48 strike an object.

Another aspect of the present invention relates to a cutting structure for cutting long and thin material such as string, tape and wire which has a tendency to become wrapped around the pivot shafts 76. As an example of this type of cutting structure, the hammers 48 of the hammermill 40 illustrated in FIGS. 2–4 include first slots 94 defined by the first surfaces 78 of the hammers 48 and second slots 96 defined by the second surfaces 80 of the hammers 48. The first slots 94 face the first plate 44 and have first cutting edges 98 located in close proximity to the first plate 44. Generally, the first slots 94 extend radially outward from adjacent to the outer perimeter of the first recesses 82. Similarly, the second slots 96 are defined by the second surfaces 80 of the hammers 48 and face the second plate 46. The second slots 96 have second cutting edges 100 aligned in close proximity to the second plate 46. Additionally, the second slots 96 extend generally radially outward from adjacent to the second recesses 84.

When the hammermill 40 is used to crush material, the cutting edges 98 and 100 of the first and second slots 94 and 96 work against their respective plates 44 and 46 as the hammers 48 pivot on the pivot shafts 76. In this manner, plastic, wire, string, and cassette tapes are cut by the cutting edges 98 and 100 against the plates 44 and 46 before being allowed to wrap around the pivot shafts 76 and interfere with the pivoting action of the hammers 48.

It will be appreciated that the number and orientation of slots used for cutting material which wraps around the pivot shafts may be varied without departing from the scope of the present invention.

With regard to the foregoing description, it is to be understood that changes may be made in detail, especially in matters of shape, size and arrangement of the parts without departing from the scope of the present invention. It is intended that the specification and depicted embodiment be considered exemplary only, with a true scope and spirit of the invention being indicated by the broad meaning of the following claims.

What is claimed is:

1. A hammermill comprising:

a main shaft rotatable about a main axis passing longitudinally through the main shaft;

a plurality of substantially parallel plates connected to the main shaft and spaced longitudinally along the main axis;

a plurality of free swinging hammers pivotally mounted between the plates on pivot shafts aligned parallel to and spaced from the main axis, the hammers defining hammer bores for receiving the pivot shafts;

lubricants contained within the hammer bores for lubricating the pivot shafts; and a plurality of spring washers mounted on the pivot shafts and compressed between the hammers and the plates, the spring washers cooperating with the plates and the hammers to form compression seals about the pivot shafts for retaining the lubricants within the hammer bores and for preventing debris from entering the hammer bores.

2. The hammermill of claim 1, wherein the spring washers are annular.

3. The hammermill of claim 1, wherein each of the hammers has first and second sides facing the plates and defining slots that open toward the plates and extend radially outward from the pivot shafts, the first and second sides of the hammers including cutting edges extending along opposite sides of the slots and located directly adjacent the plates, the cutting edges cooperating with the plates to cut material that becomes wrapped about the pivot shafts.

4. The hammermill of claim 1, wherein the hammers define recesses for receiving the spring washers and for maintaining alignment of the spring washers with the hammer bores as the hammermill is assembled.

5. A hammermill comprising:

a main shaft rotatable about a main axis passing longitudinally through the main shaft;

first and second opposing plates connected to the main shaft;

a plurality of free swinging hammers pivotally mounted between the first and second plates on pivot shafts aligned parallel to and spaced from the main axis, the hammers defining hammer bores for receiving the pivot shafts and having first sides facing the first plate and second sides facing the second plate, the first sides defining first recesses about the pivot shafts and the second sides defining second recesses about the pivot shafts;

a plurality of first spring washers mounted on the pivot shafts and compressed between the hammers and the first plate, each of the first spring washers including a first apex edge and a first base edge, the first apex edges having pressurized contact with the first plate, and each of the first base edges fitting within one of the first recesses and having pressurized contact with one of the first sides of the hammers; and a plurality of second spring washers mounted on the pivot shafts and compressed between the hammers and the second plate, each of the second spring washers including a second apex edge and a second base edge, the second apex edges having pressurized contact with the second plate, and each of the second base edges fitting within one of the second recesses and having pressurized contact with one of the second sides of the hammers, wherein the pluralities of first and second spring washers together seal the hammer bores to contain lubricants within the hammer bores and to prevent debris from entering the hammer bores.

6. The hammermill of claim 5, wherein the spring washers are annular.

7. The hammermill of claim 5, wherein the first sides of the hammers each define first slots extending radially outward from the hammer bores and opening toward the first plate, the first sides also define first cutting edges extending along opposite sides of each first slot and located adjacent to the first plate, the second sides of the hammers each define second slots extending radially outward from the hammer bores and opening toward the second plate, the second sides also define second cutting edges extending along opposite sides of each first slot and located adjacent to the first plate, and the first and second cutting edges cooperate with the first and second plates to cut material that becomes wrapped around the pivot shafts.

8. The hammermill of claim 5, wherein the hammers define openings for lubricating the pivot shafts.

9. A hammermill comprising:

a main shaft rotatable about a main axis passing longitudinally through the main shaft;

a plurality of substantially parallel plates connected to the main shaft and spaced longitudinally along the main axis;

a plurality of free swinging hammers pivotally mounted between the plates on pivot shafts aligned parallel to and spaced from the main axis, the hammers including opposing first and second sides that face the plates, the first and second sides defining slots that open toward the plates and extend radially outward from the pivot shafts, the first and second sides of the hammers also including cutting edges that extend along opposite sides of the slots and are located directly adjacent the plates, wherein as the hammers pivot about the pivot shafts, the cutting edges cooperate with the plates to cut material that becomes wrapped about the pivot shafts.

* * * * *